US007617553B1

(12) United States Patent
Faiola

(10) Patent No.: US 7,617,553 B1
(45) Date of Patent: Nov. 17, 2009

(54) PATIENT LIFTING DEVICE

(76) Inventor: Norman A. Faiola, 15 Chelseas Walk, Ithaca, NY (US) 14850

( * ) Notice: Subject to any disclaimer, the term of this patent is extended or adjusted under 35 U.S.C. 154(b) by 0 days.

(21) Appl. No.: 11/946,915

(22) Filed: Nov. 29, 2007

(51) Int. Cl.
*A61G 7/02* (2006.01)

(52) U.S. Cl. ..... 5/695; 5/655.3; 5/652

(58) Field of Classification Search ..... 5/695, 5/655.3, 644, 648, 630, 81.1 R
See application file for complete search history.

(56) References Cited

U.S. PATENT DOCUMENTS 3,609,771 A * 10/1971 Avoy ..... 4/451
4,271,546 A 6/1981 Martin
4,472,848 A 9/1984 Newman
4,998,301 A * 3/1991 Markus ..... 4/457
5,081,721 A 1/1992 Stefano
6,725,485 B2 * 4/2004 Hayes ..... 5/695
7,266,852 B2 * 9/2007 Davis ..... 5/81.1 HS

* cited by examiner

*Primary Examiner*—Fredrick Conley
(74) *Attorney, Agent, or Firm*—Wood, Herron & Evans, LLP

(57) ABSTRACT

An inflatable lifting device is disclosed for lifting the rectal area of a patient laying on a mattress. The inflatable lifting device is an inflatable U-shaped bladder with an air port to supply air into the bladder and a tether to maintain the U-shape of the bladder. The inflated bladder creates a cavity sized for the easy insertion and removal of a bedpan under the patient. The inflatable lifting device may be positioned on top of an upper surface of the mattress or within the mattress just below the upper surface.

7 Claims, 4 Drawing Sheets

PATIENT LIFTING DEVICE

FIELD OF THE INVENTION

This invention relates to a lifting device for patients who are in bed, and more particularly to a lifting device that lifts a patient adjacent to the base of his spine and enables the easy insertion and removal of a bedpan under the patient.

BACKGROUND

The use of bedpans for hospital patients who are reclined in a bed is well-known, and many types of bedpans have been developed to allow for easier use and movement. The traditional methods of placing a bedpan underneath a patient include manually lifting the hips of a patient or turning a patient on his side before sliding the bedpan in place. For most patients with spinal injuries who need to stay horizontal or stationary for treatment reasons, the manual lifting of the hips can be a very painful experience. Even for patients allowed to move on the bed, these methods of placing a bedpan beneath the patient can be discomforting and embarrassing. Consequently, there is a need for an alternative method or device to lift the posterior region of a patient without resorting to painful and often difficult manual lifting or turning of the hips.

Inflatable lifts have recently been developed to help solve some of the problems of positioning bedpans under patients. One example disclosed in U.S. Pat. No. 4,271,546 to Martin places a roughly semicircular inflation tube attached to a belt-type apparatus to be worn at all times by the patient. Another example disclosed in U.S. Pat. No. 5,081,721 to Stefano inflates the entire area under a patient like an air mattress, except for a cavity in the area large enough to slide a bedpan into. While each of these prior art devices addresses the problem of moving patients, the Stefano device requires a large amount of air to inflate and adds essentially another entire mattress to hospital beds and adds further difficulty in placing and removing the device. The Martin device can be inconvenient in situations where nothing should be attached directly to the patient in the belt area, and that device also still needs to be initially placed under a patient by lifting his hips. These limitations in the prior art need to be remedied.

SUMMARY OF THE INVENTION

This invention overcomes the problems presented by the prior art patient lifting devices as described above and other problems in the prior art. A patient lifting device according to one embodiment of this invention includes an inflatable U-shaped bladder, an air port in the bladder for inflating and deflating the bladder, and a tether coupled to the terminal ends of the U-shaped bladder to maintain the shape of the bladder. The inflated bladder defines a cavity the correct size and shape to accept a standard bedpan. The air port includes a nozzle for connection to an air supply line. The tether between the terminal ends of the U-shaped bladder is flat in order to allow easy insertion, placement, and removal of a standard bedpan in the cavity. This bladder is configured to be positioned at or below an upper surface of a mattress supporting a patient.

In one embodiment, an assembly for supporting a patient includes a mattress with an upper surface and a patient lifting device, which includes the U-shaped bladder, air port, nozzle, tether, and cavity as described above. In this embodiment the patient lifting device lies on top of the upper surface of the mattress, and an air supply line runs from an air supply, along the upper surface of the mattress, and to the nozzle at the air port. In an alternative embodiment, the patient lifting device is placed within the mattress just below the upper surface. In this alternative embodiment, the mattress further includes a side wall, an air port in the side wall, and an air supply line connecting the air port in the side wall to the air port in the bladder.

A method for placing a bedpan under a patient on a mattress is also disclosed, where the mattress has a patient lift device including an inflatable U-shaped bladder, an air port in the bladder, and an air supply line attached to the air port. The method includes delivering air through the air supply line to inflate the bladder and lift the patient, sliding a standard bedpan under the patient's raised rectal area, and moving the bedpan into the middle of the bladder. The method may also include removing the bedpan from the bladder underneath the patient and deflating the bladder by opening the air port to release the air contained in the bladder. The method then can include tethering terminal ends of the U-shaped bladder to maintain the U-shaped configuration of the bladder. Finally, the method can include embedding the bladder within the mattress and below an upper surface of the mattress when the bladder is not inflated.

BRIEF DESCRIPTION OF THE DRAWINGS

The accompanying drawings, which are incorporated in and constitute a part of this specification, illustrate exemplary embodiments of the invention and, together with a general description of the invention given above, and the detailed description given below, serve to explain the principles of the invention.

DETAILED DESCRIPTION

Figure 1:
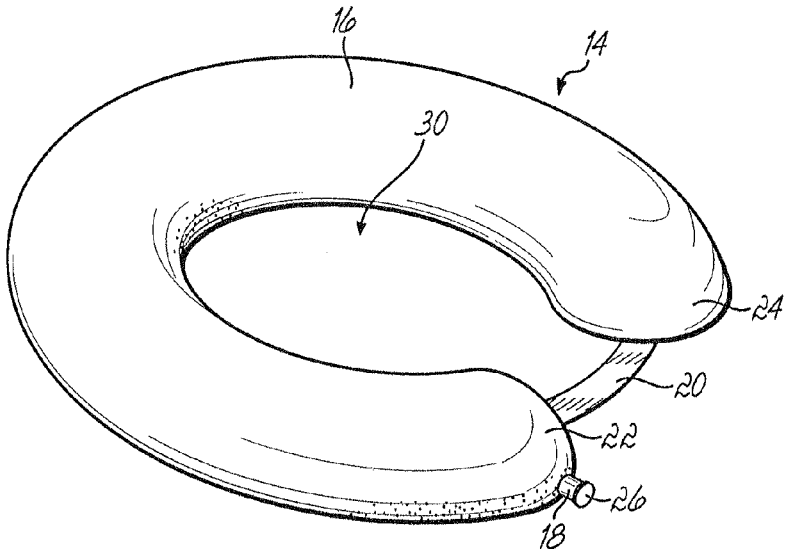
FIG. 1 is a perspective view of a patient lifting device.
Figure 2:
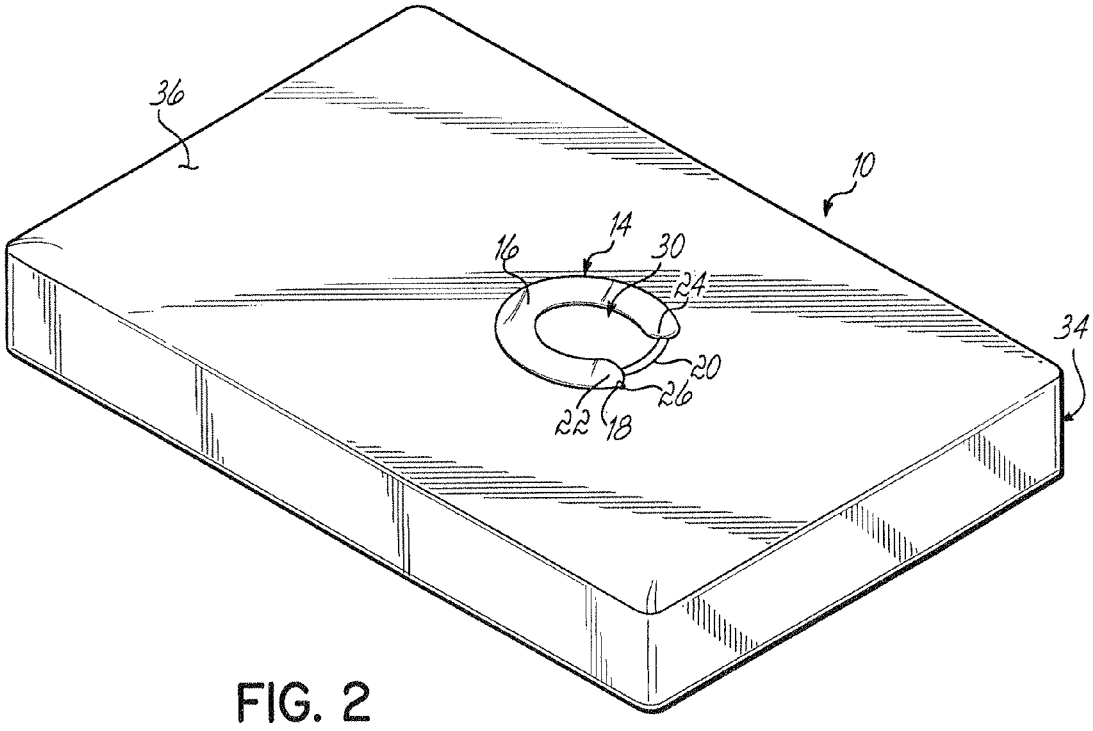
FIG. 2 is a perspective view of the patient lifting device of FIG. 1 placed on a bed mattress.

One embodiment of an assembly 10 and associated method for supporting a patient 12 including a patient lifting device 14 is shown in FIGS. 1-5B. The patient lifting device 14 comprises an inflatable U-shaped bladder 16 adapted to lift the rectal area of a supine patient 12. The bladder 16 may be made of any material suited for inflation such as rubber. The patient lifting device 14 also includes an air port 18 in the bladder 16 for inflating and deflating the bladder 16, and a tether 20 coupled near the terminal ends 22, 24 of the U-shaped bladder 16 to maintain the U-shape of the bladder 16. The air port 18 is shown in FIGS. 1-5B located near the terminal end 22 of the bladder 16, but one skilled in the art will appreciate that the air port 18 may be located anywhere convenient on the bladder.

The air port 18 includes a nozzle 26 for connecting the air port 18 to an air supply line 28. The air supply line 28 delivers air through the air port 18 to inflate the bladder 16 and lift the patient 12. When the bladder 16 is inflated, the shape of the bladder 16 defines a cavity 30 configured to accept a standard bedpan 32 inside the bladder 16 and underneath the patient 12. The tether 20 may be coupled to the terminal ends 22, 24 by adhesive or a similar method. The tether 20 in one embodiment is a flat piece of material so that the bedpan 32 can be inserted and removed from the cavity 30 in the bladder 16 without interference from the tether 20.

The assembly 10 of this embodiment further includes a mattress 34 with an upper surface 36. The patient lifting device 14 and bladder 16 may be positioned on or just below the upper surface 36. The embodiment shown in FIGS. 1-5B positions the bladder 16 on top of the upper surface 36. As shown in FIG. 5A, the bladder 16 when deflated lies on the upper surface 36 underneath the rectal area of a patient 12 and does not affect the patient 12. When the bladder 16 is inflated as shown in FIG. 5B, the rectal area of the patient 12 is lifted above the upper surface 36 enough to allow for easy insertion and removal of a bedpan 32.

Figure 6:
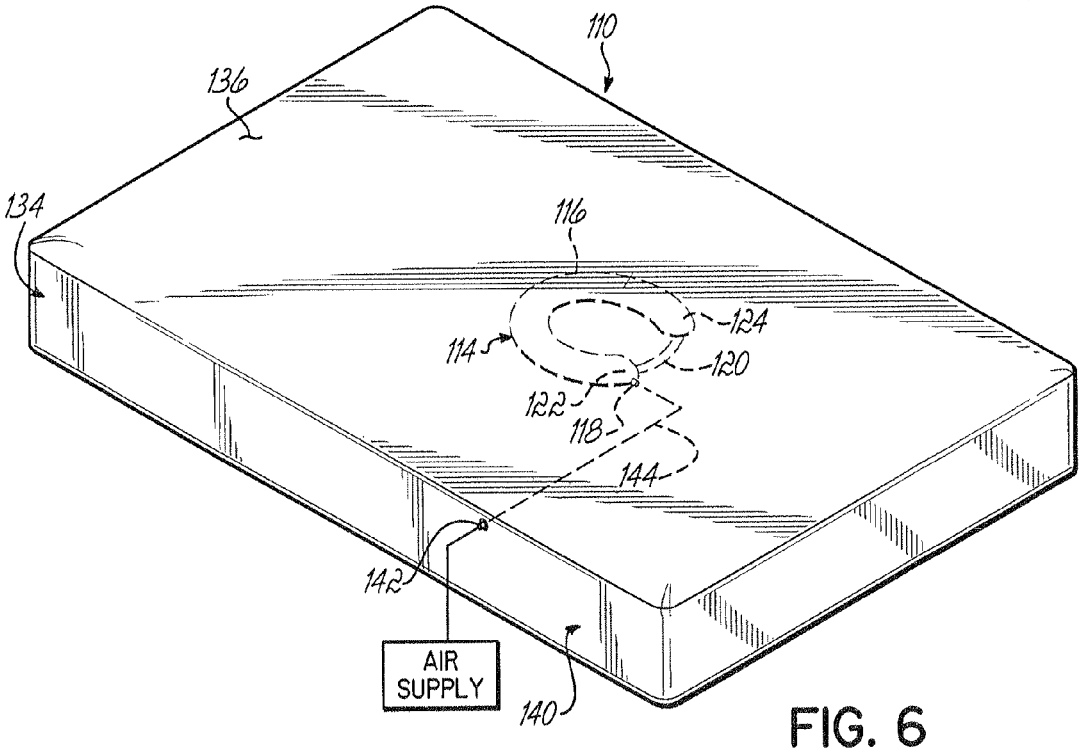
FIG. 6 is a perspective view of another embodiment of a patient lifting device where the device is placed within a bed mattress.
Figure 7:
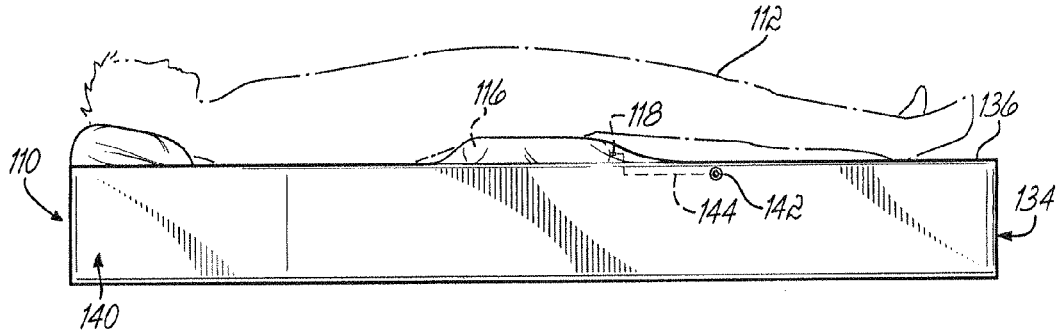
FIG. 7 is a side view of the patient lifting device of FIG. 6 where the device is inflated under a patient.

Another embodiment of an assembly 110 and associated method for supporting a patient 112 is shown in FIGS. 6-7. The assembly 110 again consists of a mattress 134 with an upper surface 136 and a patient lifting device 114. The patient lifting device 114 again consists of an inflatable U-shaped bladder 116, an air port 118, and a flat tether 120 connecting the terminal ends 122, 124 of the bladder 116. Instead of being placed on top of the upper surface 136, the patient lifting device 114 is now positioned within the mattress 134 at or just below the upper surface 136. The mattress 134 in this embodiment further includes a side wall 140, an air port 142 in the side wall 140, and an air supply line 144 connecting the air port 142 in the side wall 140 to the air port 118 in the bladder 116. The operation of this embodiment is similar to the previous embodiment, as now the bladder 116 inflates underneath the upper surface 136 of the mattress 134 as shown in FIG. 7.

Figure 3:
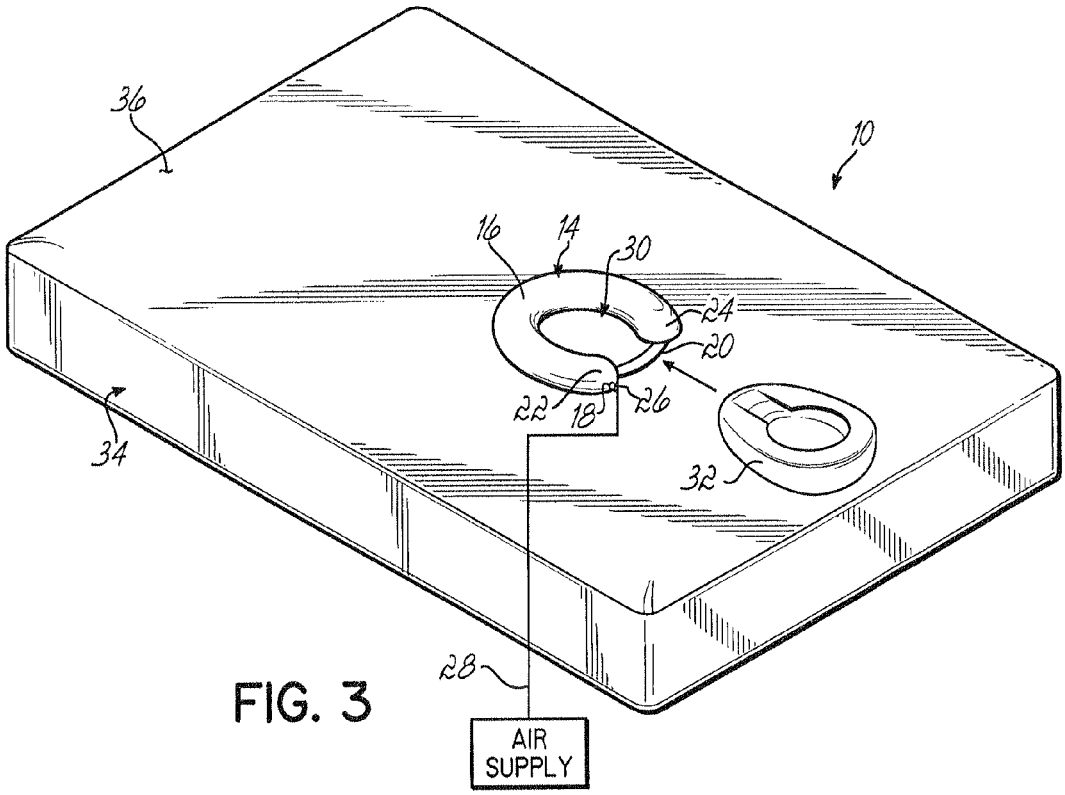
FIG. 3 is a perspective view of the patient lifting device of FIG. 1 placed on a bed mattress and showing how a bed pan is inserted into the device.
Figure 4:
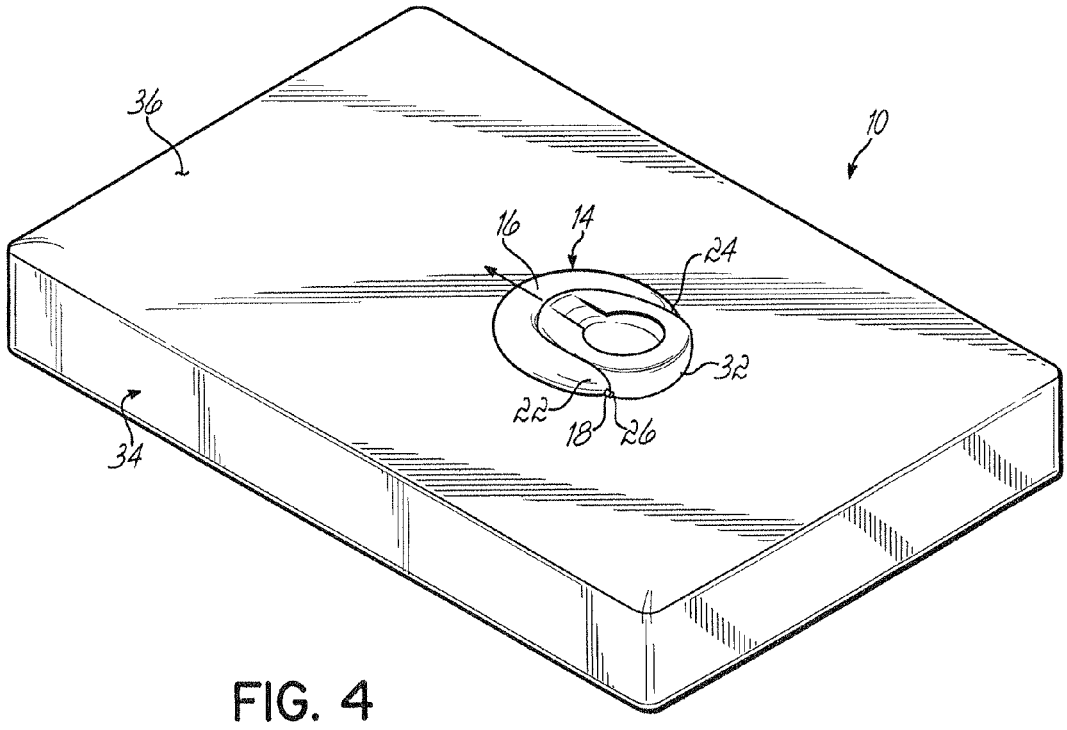
FIG. 4 is a perspective view of the patient lifting device of FIG. 1 placed on a bed mattress with a bed pan inserted into the device.
Figure 5A:
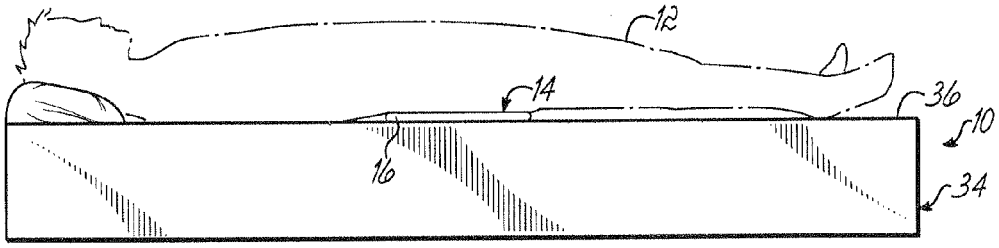
FIG. 5A is a side view of a patient lying on a bed with the patient lifting device of FIG. 1 deflated.
Figure 5B:
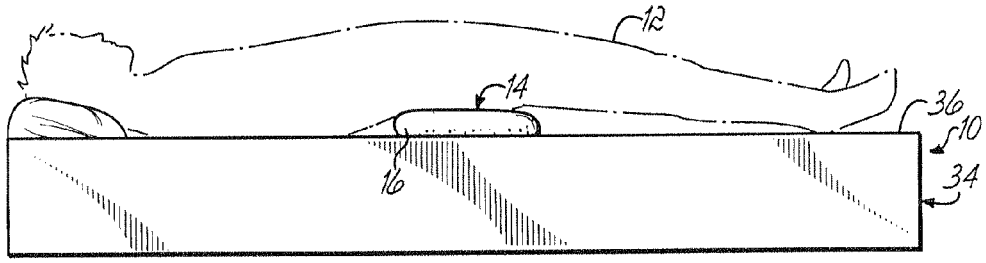
FIG. 5B is a side view of a patient lying on a bed with the patient lifting device of FIG. 1 inflated.

A method for placing a bedpan 32 under a patient 12 using the above-described patient lift devices 14, 114 is also disclosed and shown by FIGS. 1-7. The method includes delivering air through the air supply line 28 to inflate the bladder 16 and lift the patient 12, sliding a bedpan 32 under the patient's raised rectal area, and moving the bedpan 32 into the middle of the bladder 16 as shown by FIGS. 3-4. The method can further comprise removing the bedpan 32 from the bladder 16 underneath the patient 12, and deflating the bladder 16 by opening the air port 18. The method may also include tethering terminal ends 22, 24 of the U-shaped bladder 16 by attaching a tether 20 with adhesive or similar devices to maintain the bladder's configuration. In some embodiments, the method will include embedding the bladder 16 within the mattress 34 and below an upper surface 36 of the mattress 34 when the bladder 16 is not inflated.

While the present invention has been illustrated by a description of various embodiments and while these embodiments have been described in considerable detail, it is not the intention of the inventor to restrict or in any way limit the scope of the appended claims to such detail. The various features discussed herein may be used alone or in any combination. Additional advantages and modifications will readily appear to those skilled in the art. The invention in its broader aspects is therefore not limited to specific details, representative apparatus and methods, and illustrative examples shown and described. Accordingly, departures may be made from such details without departing from the spirit or the scope of the inventor's general inventive concept. The scope of the invention itself should only be defined by the following claims.

What is claimed is:

1. An assembly for supporting a patient comprising:

a mattress having an upper surface;

a patient lifting device for enabling the easy use of a hospital bedpan in combination with the mattress, the patient lifting device further comprising:

(a) an inflatable U-shaped tubular bladder positioned within the mattress just below the upper surface and adapted to lift the rectal area of a supine patient on the mattress above a horizontal plane defined by the upper surface of the mattress before inflation of the bladder;

(b) an air port in the bladder for inflating and deflating the bladder; and (c) a tether coupled proximate to the terminal ends of the bladder to maintain the shape of the bladder;

wherein the combination of the tether and the bladder when inflated defines a cavity sized and configured to accept the bedpan slid underneath the rectal area of the supine patient.

2. The patient lifting device of claim 1, wherein the air port includes a nozzle for connecting to an air supply line.

3. The patient lifting device of claim 1, wherein the tether is a flat piece of material so that a standard bedpan can be inserted into the cavity without interference from the tether.

4. The patient lifting device of claim 1, wherein the mattress includes a side wall, an air port in the side wall, and an air supply line connecting the air port in the side wall to the air port in the bladder.

5. A method for placing a bedpan under a patient lying on a mattress with a patient lift device including an inflatable U-shaped tubular bladder positioned within the mattress just below an upper surface of the mattress, an air port in the bladder, and an air supply line attached to the air port, the method comprising:

delivering air through the air supply line to inflate the bladder and lift the patient's rectal area above a horizontal plane defined by the upper surface of the mattress before inflation of the bladder;

sliding a standard bedpan under the patient's raised rectal area; and moving the bedpan into the middle of the bladder underneath the patient's rectal area.

6. The method of claim 5, further comprising:

removing the bedpan from the bladder underneath the patient; and deflating the bladder by opening the air port to release the air contained in the bladder.

7. The method of claim 5 further comprising:

tethering terminal ends of the U-shaped bladder to maintain the U-shaped configuration of the bladder.

* * * * *